US010392748B2

(12) United States Patent
Ruiz

(10) Patent No.: US 10,392,748 B2
(45) Date of Patent: Aug. 27, 2019

(54) SYSTEM AND PROCESS FOR PULPING WOOD

(71) Applicant: Veolia Water Technologies, Inc., Moon Township, PA (US)

(72) Inventor: Ivan Ramos Ruiz, Llodio (ES)

(73) Assignee: Veolia Water Technologies, Inc., Moon Township, PA (US)

( * ) Notice: Subject to any disclaimer, the term of this patent is extended or adjusted under 35 U.S.C. 154(b) by 235 days.

(21) Appl. No.: 15/302,514

(22) PCT Filed: Apr. 11, 2014

(86) PCT No.: PCT/US2014/033733

§ 371 (c)(1),
(2) Date: Oct. 7, 2016

(87) PCT Pub. No.: WO2015/156814

PCT Pub. Date: Oct. 15, 2015

(65) Prior Publication Data

US 2017/0030018 A1 Feb. 2, 2017

(51) Int. Cl.
*D21C 11/10* (2006.01)
*D21C 11/00* (2006.01)
(Continued)

(52) U.S. Cl.
CPC ..... *D21C 11/10* (2013.01); *D21C 7/00* (2013.01); *D21C 11/0042* (2013.01); *D21C 11/106* (2013.01); *D21C 11/12* (2013.01)

(58) Field of Classification Search
CPC ..... D21C 11/10; D21C 11/106
See application file for complete search history.

(56) References Cited

U.S. PATENT DOCUMENTS 3,807,479 A 4/1974 Brannland et al.
5,989,394 A 11/1999 Johansson et al.
(Continued)

FOREIGN PATENT DOCUMENTS

DE 3120586 A1 5/1982
EP 0474659 B1 8/1993
(Continued)

OTHER PUBLICATIONS

Gullichsen editor, Chemical Pulping 6B, 1999, Fapet Oy, chapter 12.*

(Continued)

*Primary Examiner* — Anthony Calandra
(74) *Attorney, Agent, or Firm* — Coats & Bennett PLLC

(57) ABSTRACT

Wood pulping process including pulping wood to produce a pulping effluent or liquor. Pre-concentrating the liquor in a pre-concentration unit produces concentrated liquor, a contaminated condensate and a non-contaminated condensate. Directing the concentrated liquor to a multi-effect train of forced circulation solids concentrators that further concentrating the concentrated liquor to form a highly concentrated liquor. Directing the contaminated condensate produced by the pre-concentration unit to a steam stripper and stripping gases therefrom and in the process producing a contaminated vapor stream. Utilizing the contaminated vapor stream and its thermal energy to power the forced circulation solids concentrators of the multi-effect train.

19 Claims, 3 Drawing Sheets

(51) Int. Cl.
*D21C 11/12* (2006.01)
*D21C 7/00* (2006.01)

(56) References Cited

U.S. PATENT DOCUMENTS

| | | | | |
|---|---|---|---|---|
| 6,258,206 | B1 | 7/2001 | Olausson et al. | |
| 8,992,729 | B2 | 3/2015 | Berg et al. | |
| 2004/0107597 | A1* | 6/2004 | Hirvonen ..... | B01D 1/065<br>34/406 |
| 2005/0098037 | A1 | 5/2005 | Dietrich et al. | |

FOREIGN PATENT DOCUMENTS

| | | | |
|---|---|---|---|
| JP | S4861701 | A | 8/1973 |
| JP | S52144401 | A | 12/1977 |
| WO | 9623566 | A1 | 8/1996 |
| WO | 9716592 | A1 | 5/1997 |
| WO | 2012012734 | A2 | 1/2012 |
| WO | 2012052619 | A1 | 4/2012 |
| WO | 2013144438 | A1 | 10/2013 |

OTHER PUBLICATIONS

Patel Jean-Claude, Black Liquor Evaporation:Design and Operation; Jan. 2008, TAPPI Kraft Recovery Course.*
Lin Ben, The Basics of Foul Condensate Stripping, Jan. 2008, TAPPI Kraft Recovery Course.*

* cited by examiner

SYSTEM AND PROCESS FOR PULPING WOOD

FIELD OF THE INVENTION

The present invention relates to wood pulping processes and more particularly to wood pulping processes including processes for concentrating pulping liquor.

SUMMARY OF THE INVENTION

This invention relates to a system and process for pulping wood which produces a wastewater stream (herein referred to as pulping effluent or liquor). The wastewater from the pulping process is directed to a pre-concentration unit. In one embodiment, the pre-concentration unit comprises one or more mechanical vapor recompression (MVR) evaporators. These evaporators concentrate the liquor to where, in one example, the solids content is approximately 15-20%. The concentrated liquor is directed to a multi-effect train that comprises a series of forced circulation solids concentrators. The concentrated liquor is heated and further concentrated in the multi-effect train, in one embodiment, to where the solids content is approximately 60-70%. The evaporators and multi-effect train is linked by a gas stripper. Contaminated condensate produced by the evaporators is directed downwardly through the gas stripper. Steam is injected into the gas stripper and strips gases such as methanol and other volatile organics from the contaminated condensate. This produces a vapor stream that is contaminated by these gases and which exits the gas stripper. This contaminated vapor stream is directed to one of the effects and the thermal energy associated therewith is utilized to heat the concentrated liquor flowing through the thermal effects and particularly a series of forced circulation solids concentrators that form the multiple effect train.

Thus, it is appreciated that in the case of a multi-effect train having three forced circulation solids concentrators, for example, the use of the contaminated vapor stream produced by the gas stripper enhances steam economy by effectively increasing the thermal effects from three to four.

Other objects and advantages of the present invention will become apparent and obvious from a study of the following description and the accompanying drawings which are merely illustrative of such invention.

DESCRIPTION OF EXEMPLARY EMBODIMENTS

The present invention relates to a wood pulping process comprising a wood pulping unit and process, a system and process for concentrating a pulping effluent or liquor produced by the pulping process, and an incinerator or boiler for burning the concentrated liquor produced by the pulping process.

Figure 1:
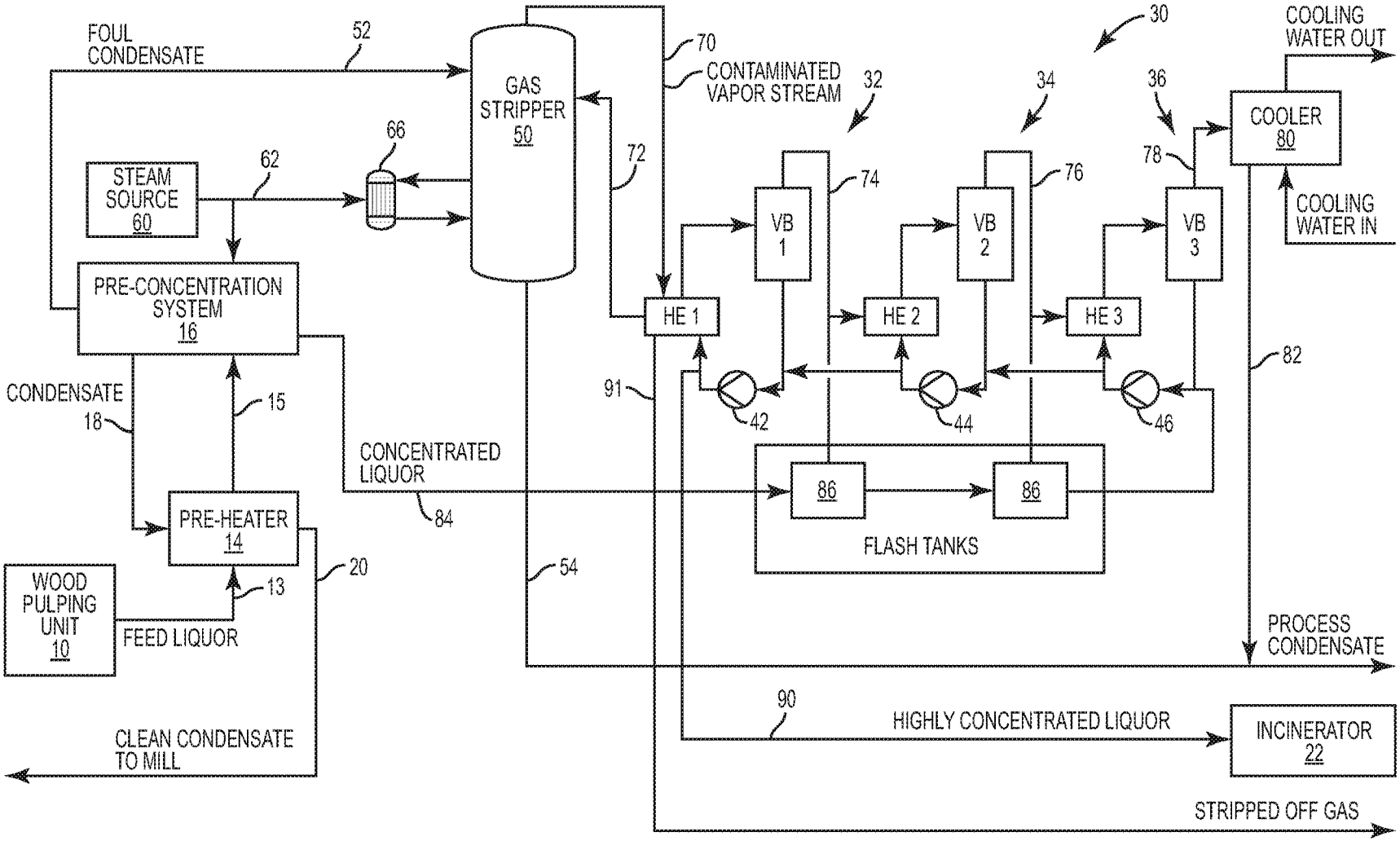
FIG. 1 is a schematic illustration of a wood pulping process according to the present invention.
Figure 2A:
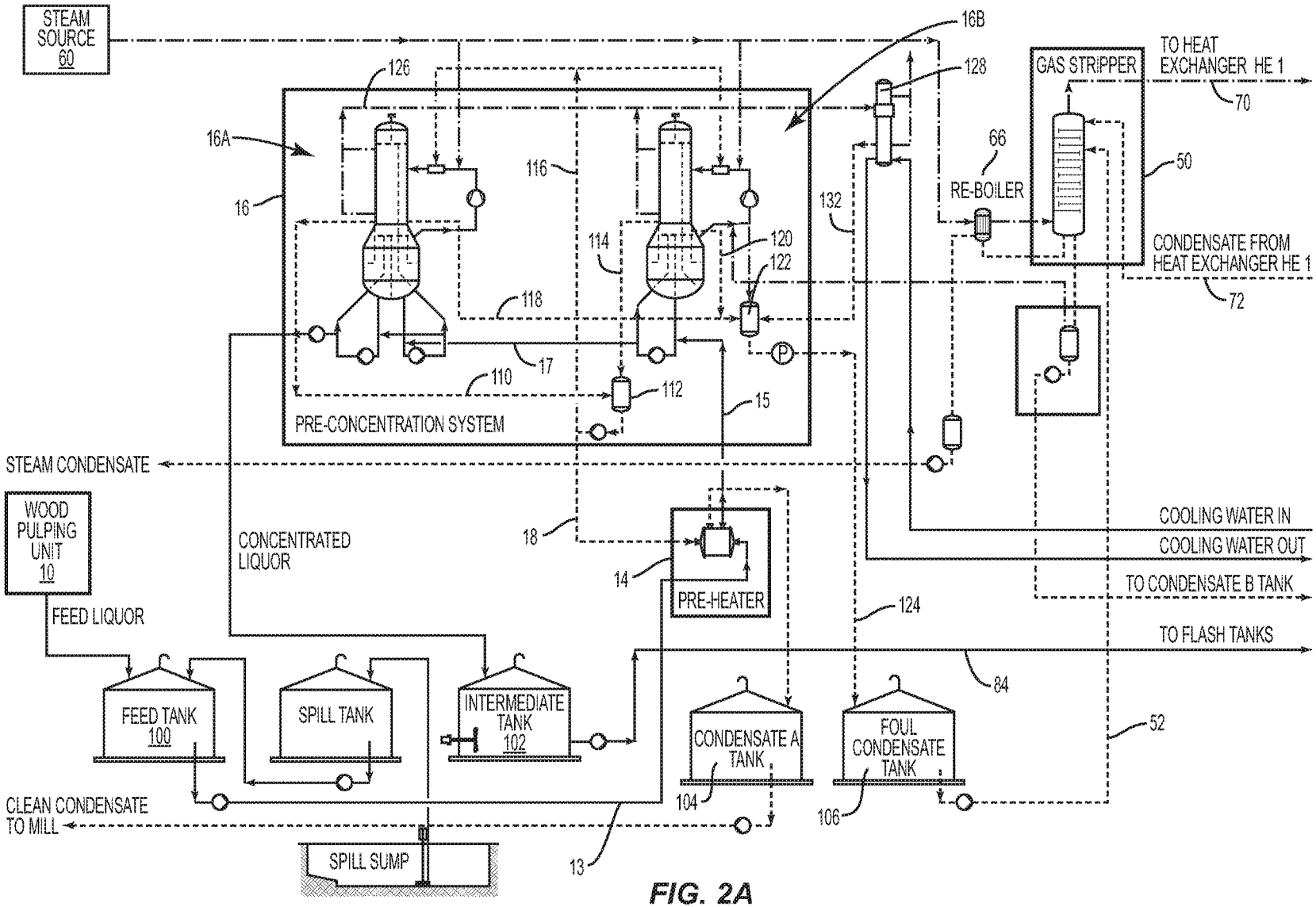
FIGS. 2A and 2B together show one particular embodiment of a wood pulping process.

As seen in FIGS. 1 and 2A, the system includes a wood pulping unit 10. Various types of wood pulping units 10 can be employed. For example, the wood pulping unit 10 may be a mechanical pulping or chemical pulping unit. Details of the pulping unit 10 and the processes carried out therein are not dealt with here in detail because such pulping units and processes are well known and appreciated by those skilled in the art. It should be noted that while the present system and process is useful for both mechanical and chemical pulping processes, it is particularly useful in mechanical pulping processes. A few examples of mechanical pulping processes might be helpful. In one type of mechanical pulping, wood is ground against a water lubricated rotating stone. The heat generated by grinding softens the lignin binding the fibers and the mechanical forces separate the fibers to form ground wood. Another mechanical technique for pulping wood where wood chips are subjected to intensive shearing forces between a rotating steel disc and a fixed plate. These types of mechanical processes have continued to be refined and there is today a pulping process that is referred to as a thermo-mechanical pulping process. Here the wood chips are pre-softened by heat and this facilitates fibrillation. In another thermo-mechanical pulping process, the wood chips are impregnated with sodium sulfide before grinding. After grinding, the pulp is sorted by utilizing a screen that separates the pulp into grades. Irrespective of the type of pulping process employed, a pulping effluent or liquor is produced. Sometimes the liquor is referred to as weak liquor. Effluent from a conventional pulping process, particularly a mechanical pulping process, typically produces a liquor having a solids concentration of approximately 1.5%. In order to effectively and efficiently dispose of the pulping effluent, it must be substantially concentrated. This enables the pulping effluent or liquor to be burned in an incinerator or boiler. As described herein, in one embodiment, the liquor produced in the pulping process begins with approximately a 1.5% dry solids (DS) and through a pre-concentrating step followed by a high concentrating step, the dry solids content of the pulping liquor is raised to approximately 60% to approximately 70%. At this level of concentration, the concentrated liquor can be efficiently burned.

The basic system and process of the present invention entails a pre-concentrating process followed by a succeeding or second concentrating process. In the pre-concentrating process, the dry solids content of the liquor is increased from approximately 1.5% DS to 15-20% DS. This forms what is referred to herein as concentrated liquor. The concentrated liquor is then directed to the second concentrating process which converts the concentrated liquor having approximately 15-20% DS to a highly concentrated liquor having 60-70% DS. The term "highly concentrated liquor" is a relative term, a term whose meaning is relative to the term "concentrated liquor" produced in the pre-concentrating processes. That is, "highly concentrated liquor" means that the dry solids content of the highly concentrated liquor is greater than the dry solids content of the "concentrated liquor".

In the pre-concentrating process, to be described in greater detail below, not only is concentrated liquor produced but the process also produces a contaminated or foul condensate, as well as a non-contaminated condensate. The term "non-contaminated condensate" is also a relative term that means that this particular condensate is less contaminated than the contaminated condensate.

The pre-concentrating process and the second concentrating process are linked by a gas stripper whose function is to treat contaminated condensates. The contaminated condensates, for example, are directed downwardly through the gas stripper and steam is injected into a lower portion of the stripper and rises up through the stripper, stripping contaminants, particularly gases such as methanol and volatile organics, from the contaminated condensates. Thus, a contaminated vapor stream is produced in the gas stripper. This contaminated gas stream includes substantial thermal energy and is directed to the second concentrating process where the thermal energy associated with the contaminated vapor stream is utilized to power the second liquor concentrating process. As will be discussed later, in one embodiment the second concentrating process is carried out by a multi-effect train of forced circulation solids concentrators. The thermal energy of the contaminated vapor stream produced by the gas stripper is utilized to power the forced circulation solids concentrators that form the multi-effect train.

Turning now to FIG. 1, one embodiment of the pulping process of the present invention is shown therein. Wood or wood chips are directed into a wood pulping unit 10 that, as discussed above, performs a pulping process. Wood pulping unit 10 produces a pulping effluent that is referred to herein as a liquor. The liquor (feed liquor) is directed via line 13 to and through a pre-heater 14. Pre-heater 14 heats the feed liquor. From the pre-heater 14, the liquor is directed to a pre-concentration system 16. In one embodiment, as shown in FIG. 2A, the pre-concentration system 16 comprises two mechanical vapor recompression (MVR) evaporators 16A and 16B. The evaporators 16A and 16B are basically powered with electricity that drives compressors that compress vapor. The primary function of the pre-concentration system 16 is to pre-concentrate the liquor. Pre-concentration system 16 produces a concentrated liquor that is directed through line 84 to a second concentration system, indicated generally by the numeral 30. This second concentration system 30 will be discussed subsequently herein.

In addition to the concentrated liquor, the pre-concentration system 16 produces a clean or non-contaminated condensate that is directed from the pre-concentration system via line 18 through the pre-heater 16. Since the clean condensate is relatively hot, it effectively heats the liquor passing from the wood pulping unit 10 to the pre-concentration system 16. After passing through the pre-heater 14, the clean condensate is directed through line 20 to the pulp mill for further use. Pre-concentration system 16 also produces a contaminated or foul condensate that is directed from the pre-concentration system 16 to a gas stripping unit 50 that will be subsequently discussed in detail.

Concentrated liquor produced by the pre-concentration system 16 is directed to a final or second concentration system indicated generally by the numeral 30. The function of the second concentration system 30 is to substantially concentrate the concentrated liquor produced by the pre-concentration system 16. As will be discussed subsequently herein, in one embodiment the concentrated liquor produced by the pre-concentration system 16 has a dry solids content (by weight) of approximately 15% to approximately 20%. The second concentration system 30, in one embodiment, is designed to further concentrate the concentrated liquor to a dry solids content of approximately 60% to 70%. At this concentration, the liquor can be burned in an incinerator or boiler.

Referring to the second concentration system 30 in more detail, in one embodiment, the system comprises a multi-effect train comprised of three forced circulation solids concentrators referred to generally by the numerals 32, 34 and 36. Forced circulation solids concentrator 32 forms a first effect, forced circulation solids concentrator 34 forms a second effect and forced circulation solids concentrator 36 forms a third effect. These forced circulation solids concentrators include vapor bodies denoted VB 1, VB 2 and VB 3. Further, they include heat exchangers HE 1, HE 2 and HE 3. Finally, the forced circulation solids concentrators include recirculation pumps identified by the numerals 42, 44 and 46.

Pre-concentration system 16 and the second concentration system 30 are linked by the gas stripper 50. Gas stripper 50 functions to remove contaminants from the contaminated condensate produced by the pre-concentrating system 16 and the resulting vapor stream is utilized to supply thermal energy for driving the second concentration system 30.

As shown in FIG. 1, the contaminated condensate is directed from the pre-concentration system 16 into an upper portion of the gas stripper 50. Steam from a steam source 60 is directed via line 62 to a re-boiler 66. Condensate from the steam stripper 50 is circulated through the re-boiler 66 and portions of the circulated condensate is converted to steam that moves upwardly through the steam stripper, stripping contaminated gases such as methanol and volatile organics from descending condensate. Treated condensate exiting the bottom of the gas stripper 50 is directed through line 54 and forms process condensate.

Steam generated by the re-boiler 66 moves up through the gas stripper 50 and out an upper vent therein. This results in a contaminated vapor stream that includes substantial thermal energy. In one embodiment, there is sufficient thermal energy in the contaminated vapor stream to substantially drive the forced circulation solids concentrators 32, 34 and 36, discussed above. To utilize this thermal energy, the contaminated vapor stream is directed from the gas stripper 50 via line 70 to heat exchanger HE 1 associated with the first forced circulation solids concentrator 32. The contaminated vapor stream enters HE 1 and heats concentrated liquor passing therethrough. There is substantial thermal energy associated with the contaminated vapor stream directed through HE 1 and this vaporizes water in the concentrated liquor, producing additional vapor and further concentrating the liquor passing through HE 1. The contaminated vapor stream entering HE 1 condenses and forms another condensate that may also be contaminated with COD and this contaminated condensate is directed from HE 1 via line 72 into an upper portion of the gas stripper 50 where the contaminated condensate from HE 1 combines with the contaminated condensate produced by the pre-concentration system 16. Thus, the two contaminated condensates combine in the gas stripper 50 and descend through the uprising steam where the steam removes gases from both.

Energy associated with the contaminated vapor stream produces additional vapor that is collected in VB 1 of the first forced circulation solids concentrator 32. Vapor collected in VB 1 is sometimes referred to as a secondary vapor stream. It is used to power the second effect or the second forced circulation solids concentrator 34. As seen in FIG. 1, this secondary vapor stream produced in forced circulation solids concentrator 32 is directed through line 74 to heat exchanger HE 2 associated with the second forced circulation solids concentrator 34. Here again the thermal energy associated with the secondary vapor stream is utilized to heat and vaporize liquor passing through HE 2. The secondary vapor stream heats the concentrated liquor and forms a new vapor stream in VB 2 that is also referred to as a secondary vapor stream. This secondary vapor stream is vented from VB 2 and directed through line 76 to heat exchanger HE 3 of the third effect or the third forced circulation solids concentrator 36. Here again, the vapor in line 76 is utilized to heat and vaporize concentrated liquor passing through HE 3 and this produces another vapor stream that is collected in VB 3. Vapor collected in VB 3 is directed to a cooler or condenser 80 where the vapor is condensed to form a condensate that exits the cooler via line 82 and forms a part of the process condensate.

Thus, it is seen that the thermal energy associated with the contaminated vapor stream exiting the gas stripper 50 is utilized to drive the multi-effect train of forced circulation solids concentrators and to further concentrate the pre-concentrated liquor produced by the pre-concentration system 16.

To further concentrate the liquor in line 84, the liquor is directed into a pair of flash tanks 86. There is significant thermal energy associated with the concentrated liquor in line 84 and, hence, upon reaching the flash tanks 86, some of the liquor flashes into steam. Steam in the first flash tank is directed into HE 2 and supplements the heat energy supplied by the secondary vapor stream in line 74. Steam in the second flash tank is directed to HE 3 and supplements the heat energy supplied by the secondary vapor stream in line 76.

From the flash tanks 86, the concentrated liquor is directed to the third or final effect, the forced circulation solids concentrator 36. The concentrated liquor is continuously circulated by the pump 46 through the heat exchanger HE 3 and vapor body VB 3. Because water in the concentrated liquor is continuously vaporized, it follows that the concentrated liquor is further concentrated in this third effect. Portions of the concentrated liquor is bled from the third effect and directed to the second effect or the second forced circulation solids concentrator 34. There the pump 46 continuously circulates the concentrated liquor through HE 2 to VB 2 and back to the pump. Like in the third effect, the second effect continues to concentrate the concentrated liquor being circulated through the second effect. A portion of the concentrated liquor is bled from that being circulated in the second effect 34 and is directed to the first effect 32. There the concentrated liquor is pumped by pump 42 through heat exchanger HE 1 and through VB 1 and back to the pump. This circulation of the concentrated liquor and its exposure to the thermal energy in the heat exchanger HE 1 further concentrates the concentrated liquor being circulated through the first forced circulation solids concentrator 32. Heat exchanger HE 1 includes a vapor vent for venting vapor therefrom. This vapor vent is connected to line 91. This vapor is typically concentrated with methanol and other volatile compounds and can be directed to a trim condenser. The vapor from the trim condenser is considered as stripped of gas (SOG) and is sent outside the battery limits of the pulp plant. Heat exchanger HE 1 also includes a liquor outlet that is connected to line 90. Liquor exiting HE 1 is highly concentrated. As noted before, in one embodiment, this liquor has a dry solids content on the order of 60-70%. This highly concentrated liquor is sufficiently concentrated that it can be economically and practically disposed of through incineration. In the case of the embodiment illustrated herein, the highly concentrated liquor in line 90 is directed to an incinerator or boiler 22.

Figure 2B:
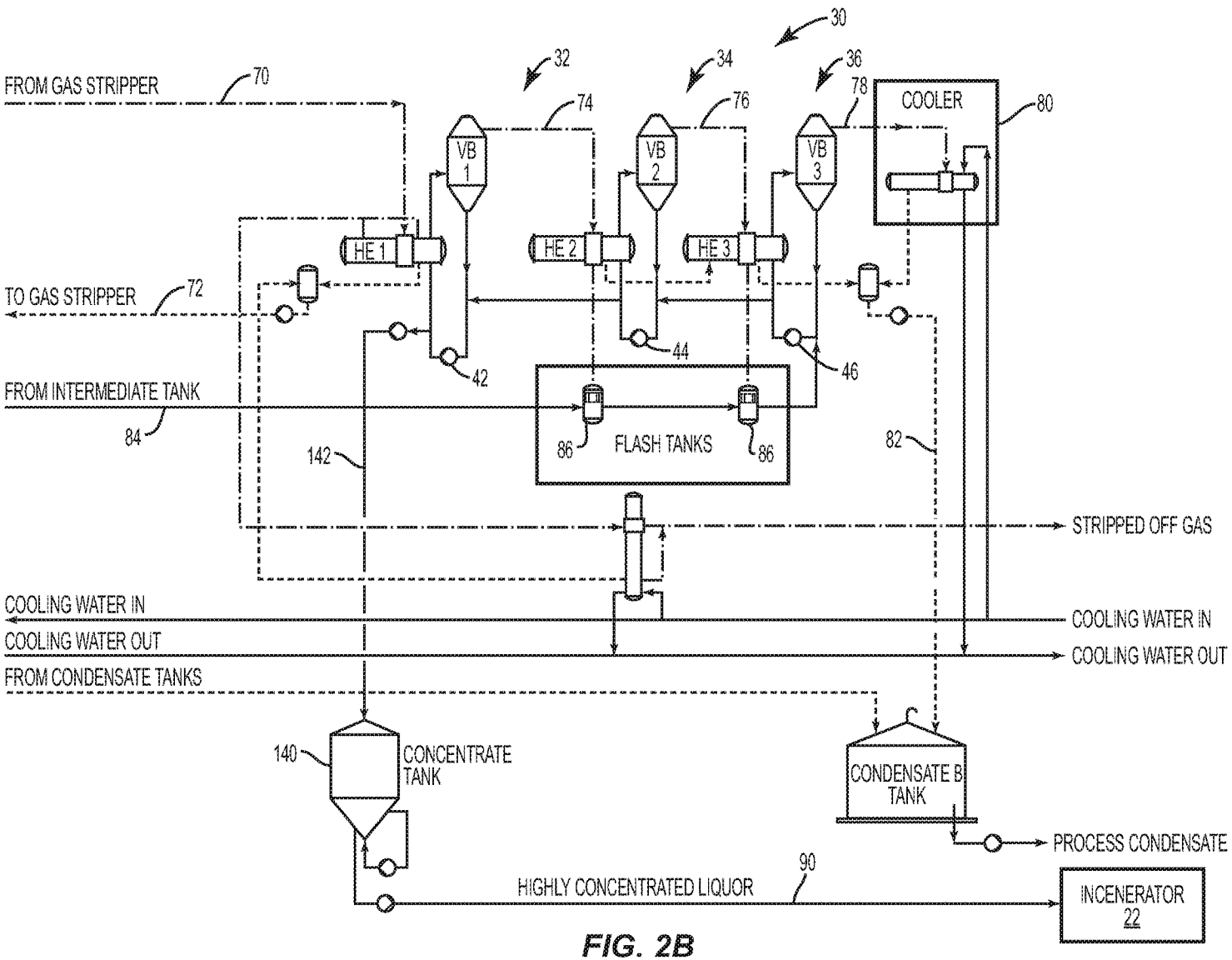

FIGS. 2A and 2B show another embodiment of the wood pulping process. This process is similar in many respects to the process shown in FIG. 1 but does differ in some specifics. Turning to FIG. 2A, the wood pulping unit 10 produces a liquor that is directed into a feed tank 100. From the feed tank 100, the liquor is directed through line 13 through the pre-heater 14 and through line 15 extending from the pre-heater to the pre-concentration unit 16. In this embodiment, the pre-concentration unit 16 includes two MVR evaporators 16A and 16B. Liquor in line 15 is first directed into a recirculation line associated with the first evaporator 16B. Evaporators 16A and 16B, in this embodiment, are falling film evaporators. Concentrated liquor in the sump of the evaporator 16B is recirculated through a top portion of the evaporator where the liquor is discharged into heat transfer tubes. The liquor forms a thin film on the inside of the heat transfer tubes and falls down to the sump. In this process, steam is supplied to the shell side of the evaporator, causing portions of the thin film of liquor to be evaporated and, hence, concentrated. This produces a vapor that is directed to a compressor that compresses the same and injects the compressed vapor or steam into the shell side of the evaporator. The liquor directed to the first evaporator 16B is continuously recirculated through the evaporator to concentrate the same. Liquor in the first evaporator 16B is directed through line 17 to the second evaporator 16A. It includes a dual recirculation loop. Here the liquor is pumped from the sump of the evaporator 16A, through the two recirculation loops to the upper portion of the evaporator where the liquor is discharged into the heat transfer tubes in a manner similar to that described with respect to evaporator 16B. Liquor is continuously recirculated through the evaporator 16A until it is concentrated to a selected degree. In the case of one embodiment, the liquor in line 15 directed to the pre-concentration unit 16 has a dry solids content of approximately 1.5%. In this embodiment, the concentrated liquor leaving evaporator 16A and passing through line 84 to tank 102 has a dry solids content of approximately 15-20%.

As discussed with the embodiment shown in FIG. 1, evaporators 16A and 16B are designed such that they each produce a foul or contaminated condensate and a clean or non-contaminated condensate. First, as viewed in FIG. 2A, evaporator 16A produces a non-contaminated condensate that is directed through line 110 to a condensate tank 112. Evaporator 16B produces a non-contaminated condensate stream that is directed through line 114 to the condensate tank 112. From the condensate tank 112, the condensate is pumped through the pre-heater 14 to the condensate tank 104. A small fraction of the liquid condensate is directed through line 116 to the vapor circuit of each evaporator to be used as the de-superheating media in evaporators 16A and 16B. Effectively the condensate flashes into the vapor lines, cooling down the superheated vapor produced by the compressors down to a temperature close to the saturation temperature.

As viewed in FIG. 2A, the foul or contaminated condensate flows out the right side of evaporators 16A and 16B. Lines 118 and 120 direct contaminated condensate to a condensate tank 122. From the condensate tank 122, the contaminated condensate flows through line 124 to foul or contaminated condensate tank 106. Evaporators 16A and 16B also produce a contaminated vapor that is directed out line 126 to a condenser 128 that condenses the vapor and forms a contaminated condensate that is directed through line 132 to the condensate tank 122.

Continuing to refer to FIG. 2A, steam from a stream source 60 is directed to a re-boiler 66. Some steam from the steam source 60 is used as makeup steam for the evaporators 16A and 16B. Condensate in the steam stripper 50 is circulated through the re-boiler 66 and converted to steam that is introduced into the lower portion of the steam stripper. Steam from the steam source 60 condenses and is directed from the re-boiler as steam condensate. The contaminated condensate in tank 106 is pumped via line 52 into an upper portion of the steam stripper 50. This contaminated condensate then descends downwardly through the steam stripper 50 while the steam therein moves upwardly. The steam strips gases, such as methanol and volatile organics, from the contaminated condensate. The steam exits a vent in the upper portion of the steam stripper 50 as a contaminated vapor stream. It is contaminated in the sense that it includes gases stripped from the contaminated condensate. As discussed above, this contaminated vapor stream includes substantial thermal energy that can be utilized to power the second concentration system 30 shown in FIG. 2B. More particularly, the contaminated vapor stream is directed from the steam stripper 50 via line 70 into heat exchanger HE 1 of the first forced circulation solids concentrator 32. The contaminated vapor stream passing through heat exchanger HE 1, heating the concentrated liquor passing therethrough and, at the same time, causes a secondary vapor stream to be collected in VB 1, which is directed via line 74 to heat exchanger HE 2 in the second effect 34. The contaminated vapor stream entering HE 1 condenses and forms a condensate that again may include some contaminant gases. This contaminated condensate is directed from HE 1 via line 72 into the gas stripper 50 for treatment. See FIGS. 2A and 2B. This process continues as described above. The thermal energy associated with the secondary vapor stream directed to the second effect is used to form another secondary vapor stream that is directed from VB 2 via line 76 to heat exchanger HE 3.

Continuing to refer to FIGS. 2A and 2B, concentrated liquor in intermediate tank 102 is directed through line 84 to the flash tanks 86. As discussed before, flash tanks 86 produce steam that is directed into heat exchangers HE 2 and HE 3. This supplements the thermal energy being directed to these two heat exchangers by the secondary vapor streams in lines 74 and 76. From the flash tanks 86, the concentrated liquor is fed, in series, to the forced circulation solids concentrators 32, 34 and 36. The feed of the concentrated liquor is from the third concentrator 36 to the first concentrator 32. Again, in each case the concentrated liquor is circulated by a respective pump through a heat exchanger and through an associated vapor body and back to the pump. In the process, the concentrated liquor is progressively concentrated as it is concentrated in each of the concentrators and as it moves from the third concentrator 36 to the first concentrator 32. Concentrated liquor leaving the first forced circulation solids concentrator 32 is directed through line 142 to the concentrate tank 140. The concentrated liquor received by concentrate tank 140 is substantially concentrated compared to the liquor entering the second concentration system 30. In one embodiment, the dry solids content of the concentrated liquor in line 142 is approximately 60-70% dry solids. As discussed before, the concentrated liquor in the concentrate tank 140 is directed via line 90 to an incinerator 22 or other apparatus, such as a boiler, for burning the highly concentrated liquor.

In one embodiment, the forced circulation solids concentrators 32, 34 and 36 are designed to enhance heat transfer to the liquor passing through the tubes of the heat exchangers HE 1, HE 2 and HE3. This is achieved by inserting what is termed enhancers in the heat exchanger tubes. In one embodiment, a spiral-shaped element is inserted into each heat exchanger tube for the purpose of inducing a spiral flow path within the tube. Thus, the liquor entering the respective heat exchanger tubes moves through the tubes in a generally spiral path. It is generally accepted that streams having laminar flow characteristics can have lower heating rates than streams having turbulent flow characteristics because of a difference in temperature gradient. Thus, it is postulated that a more efficient heat transfer can be achieved by inducing the liquor to flow in a spiral path as the liquor moves through the respective tubes of the heat exchangers HE 1, HE 2 and HE 3.

It should be noted that the steam stripping process and resulting vapor stream effectively form a fourth thermal stage with the other three thermal stages being formed by the forced circulation solids concentrators 32, 34 and 36. Here the stripping system can be viewed as the first thermal stage with the forced circulation solids concentrators 32, 34 and 36 being viewed as the second, third and fourth thermal stages.

The overall system and process of the present invention is performed in a manner that is designed to avoid or at least reduce high temperatures that increase the scaling potential due in substantial part to the inverse solubility of salts. Another consideration in the design of a wood pulping process such as disclosed herein relates to the suspended solids in the liquor feed. For example, compared to a conventional Kraft liquor, the concentration factor for mechanical pulp effluent, for example, is much higher. In a Kraft liquor, for example, the concentration factor may be on the order of approximately 4.5 where in processes similar to that disclosed herein the concentration factor could be 40 or higher. This means that for a similar suspended solids content in the feed liquor, as the liquor becomes more concentrated, the concentration of suspended solids will increase much more in a process such as described here than in a conventional Kraft process. Therefore, in one embodiment of the present invention, the aim is to use an evaporator technology to concentrate the liquor up to approximately 15% to approximately 20% DS and then a shift the process to a forced circulation technology embodied in a multi-effect train.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A wood pulping process comprising:

pulping wood and producing a liquor;

pre-concentrating the liquor in one or more evaporators to produce a concentrated liquor, a contaminated condensate, and a non-contaminated condensate;

directing the concentrated liquor from the one or more evaporators to one or more flash tanks;

flashing the concentrated liquor in the one or more flash tanks to form a flashed concentrated liquor and generating steam therefrom and directing the generated steam to a multiple effect train including a series of forced circulation solids concentrators directing the flashed concentrated liquor to the multiple effect train that further concentrates the flashed concentrated liquor to form a highly concentrated liquor;

linking the one or more evaporators that perform the pre-concentrating step with the multiple effect train with a gas stripping unit;

directing the contaminated condensate to the gas stripping unit;

steam stripping the contaminated condensate in the gas stripping unit and producing a vapor stream having contaminants stripped from the contaminated condensate;

directing the vapor stream from the gas stripping unit to one of the effects of the multiple effect train and heating the flashed concentrated liquor passing through the effect by transferring heat from the vapor stream to the flashed concentrated liquor and employing the thermal energy associated with the vapor stream to power one or more of the other effects of the multiple effect train and to heat the flashed concentrated liquor passing therethrough;

and burning the highly concentrated liquor produced by the multiple effect train in an incinerator or boiler.

2. The method of claim 1 wherein the liquor is pre-concentrated by the one or more evaporators to approximately 15% DS to approximately 20% DS.

3. The method of claim 1 wherein the flashed concentrated liquor is concentrated by the multiple effect train to approximately 60% DS to approximately 70% DS.

4. The method of claim 1 wherein at least one effect of the multiple effect train produces a second contaminated condensate and the method includes directing the second contaminated condensate from the multiple effect train to the stripping unit and steam stripping the second contaminated condensate in the stripping unit.

5. The method of claim 1 wherein the multiple effect train includes an initial effect and a last effect and the method includes directing the flashed concentrated liquor to the last effect and from the last effect to the initial effect and through any intervening effects and in the process, concentrating the flashed concentrated liquor to form the highly flashed concentrated liquor; and heating the flashed concentrated liquor passing from the last effect to the initial effect by directing the vapor stream from the stripping unit to the initial effect and transferring heat from the vapor stream to the flashed concentrated liquor passing through the initial effect and producing a first effect vapor that is utilized to heat, directly or indirectly, the flashed concentrated liquor passing through one or more of the other effects.

6. The method of claim 1 wherein each effect includes a vapor body, a recirculation pump, and a heat exchanger having a plurality of tubes for receiving the flashed concentrated liquor and wherein the method includes circulating the flashed concentrated liquor through the vapor body and heating the tubes in the heat exchanger and directing the flashed concentrated liquor through the tubes and inducing the flashed concentrated liquor to move in a spiral path through the tubes to enhance heat transfer to the flashed concentrated liquor.

7. The method of claim 6 wherein the multiple effect train includes a first effect, a last effect, and optionally one or more intervening effects, and the method includes:

directing the vapor stream from the stripping unit into the heat exchanger of the first effect and heating the flashed concentrated liquor passing through the heat exchanger of the first effect and producing a first effect vapor that is utilized to heat the flashed concentrated liquor passing through the heat exchangers of one or more other effects.

8. The method of claim 1 wherein the vapor stream emitted from the stripping unit produces, directly or indirectly, one or more secondary vapor streams that are used to heat the flashed concentrated liquor flowing through the multiple effects.

9. The method of claim 8 including directing the flashed concentrated liquor through the multiple effects in a general direction counter to the flow direction of the vapor stream and the one or more secondary vapor streams.

10. The method of claim 1 wherein the multi-effect train includes a first forced circulation solids concentrator, a second forced circulation solids concentrator, and a third forced circulation solids concentrator; each forced circulation solids concentrator including a vapor body, heat exchanger and a recirculation pump; and the method includes directing the flashed concentrated liquor through a series of the forced circulation solids concentrators and heating the flashed concentrated liquor passing therethrough by directing the vapor stream from the steam stripping unit to the heat exchanger of the first forced circulation solids concentrator and producing a secondary vapor stream; and directing the secondary vapor stream to the heat exchanger of the second forced circulation solids concentrator and producing a second secondary vapor stream; and directing the second secondary vapor stream to a heat exchanger associated with the third forced circulation solids concentrator; and wherein the heat energy associated with the vapor stream emitted by the steam stripping unit is utilized to further concentrate the flashed concentrated liquor and form the highly concentrated liquor that is emitted from the forced circulation solids concentrators.

11. The method of claim 1 including:

directing the non-contaminated condensate from the one or more evaporators to a pre-heater;

directing the liquor through the pre-heater before the liquor reaches the one or more evaporators; and employing the non-contaminated condensate to heat the liquor passing through the pre-heater.

12. A wood pulping process comprising:

pulping wood and producing a liquor;

pre-concentrating the liquor in one or more evaporators to produce a concentrated liquor, a contaminated condensate, and a non-contaminated condensate;

directing the concentrated liquor from the one or more evaporators to one or more flash tanks;

concentrating the concentrated liquor in the one or more flash tanks by flashing some of the concentrated liquor into steam and producing a flashed concentrated liquor;

directing the flashed concentrated liquor to a multiple effect train including a series of forced circulation solids concentrators that further concentrate the flashed concentrated liquor to form a highly concentrated liquor;

linking the one or more evaporators that perform the pre-concentrating step with the multiple effect train;

directing the contaminated condensate to a gas stripping unit;

steam stripping the contaminated condensate in the gas stripping unit and producing a vapor stream having contaminants stripped from the contaminated condensate;

directing the vapor stream from the gas stripping unit to one of the effects of the multiple effect train and heating the flashed concentrated liquor passing through the effect by transferring heat from the vapor stream to the flashed concentrated liquor and employing the thermal energy associated with the vapor stream to power one or more of the other effects of the multiple effect train and to heat the flashed concentrated liquor passing therethrough;

directing the flashed steam from the one or more flash tanks to the one or more forced circulation solids concentrators of the multiple effect train; and burning the highly concentrated liquor produced by the multiple effect train in an incinerator or boiler.

13. A wood pulping system comprising:

(a) a pulping unit for pulping wood or wood chips and which produces a liquor;

(b) a pre-concentration unit for receiving the liquor from the pulping unit and concentrating the same, the pre-concentration unit comprising at least two evaporators for receiving the liquor and producing:
(i) a concentrated liquor;
(ii) a contaminated condensate;
(iii) a non-contaminated condensate;
(c) one or more flash tanks forming a part of the wood pulping system;
(d) a line operatively connected between the pre-concentration unit and the one or more flash tanks for directing the concentrated liquor from the pre-concentration unit into the one or more flash tanks;
(e) wherein the one or more flash tanks are configured to further concentrate the concentrated liquor by flashing the concentrated liquor to form flashed concentrated liquor and generating steam therefrom;
(f) a multi-effect train including a series of forced circulation solids concentrators for receiving the flashed concentrated liquor and further concentrating the flashed concentrated liquor to form a highly concentrated liquor;
(g) each forced circulation solids concentrator including:
(i) a heat exchanger;
(ii) a recirculation pump;
(iii) a vapor outlet;
(iv) and wherein the recirculation pump is operative to circulate the flashed concentrated liquor through the forced circulation solids concentrator and the heat exchanger thereof;
(h) a steam conveying line operatively connected between the one or more flash tanks and the multiple effect train for conveying steam from the one or more flash tanks to the multiple effect train;
(i) a steam stripping unit having an inlet for receiving the contaminated condensate produced by said evaporators and having a steam inlet for receiving steam from a steam source;
(j) the steam stripping unit being operative to strip contaminants from the contaminated condensate and produce a contaminated vapor stream;
(k) a first conduit operatively interconnected between the steam stripping unit and at least one effect of the multi-effect train for directing the contaminated vapor stream from the steam stripping unit to the one effect and heating the flashed concentrated liquor passing through the one effect and producing a secondary vapor stream, resulting in the flashed concentrated liquor being further concentrated in the one effect;
(l) one or more additional vapor conduits operatively connected between one or more of the multiple effects for directing the secondary vapor stream or other vapor streams produced directly or indirectly thereby, from one effect to another effect; and
(m) an incinerator or boiler for receiving at least a portion of the highly concentrated liquor and burning the same.

14. The system of claim 13 wherein the multi-effect train includes a first forced circulation solids concentrator and a last forced circulation solids concentrator and wherein the first conduit is operatively connected between the steam stripping unit and the heat exchanger of the first forced circulation solids concentrator for directing the contaminated vapor stream from the steam stripping unit into and through the heat exchanger of the first forced circulation solids concentrator.

15. The system of claim 13 wherein the one or more flash tanks are operatively connected to one or more heat exchangers of the forced circulation solids concentrators for directing flashed steam into the one or more heat exchangers.

16. The system of claim 14 including a condensate line that extends from the heat exchanger associated with the first forced circulation solids concentrator to the steam stripping unit for directing condensate from the heat exchanger associated with the first forced circulation solids concentrator to the steam stripping unit where contaminant gases are stripped from the condensate.

17. The system of claim 13 wherein the steam stripping unit includes a second condensate inlet and wherein there is provided a condensate line operatively connected between the second condensate inlet and said one effect such that condensate produced by said one effect is directed to the steam stripping unit for treatment.

18. The system of claim 13 including a feed line connected in series between the two evaporators such that the liquor is first fed to a second evaporator and then to a first evaporator.

19. The system of claim 18 wherein the second evaporator is provided with a pair of separate recirculation loops for circulating liquor through the second evaporator.

* * * * *